US011149593B2

(12) United States Patent
Abrahamson et al.

(10) Patent No.: US 11,149,593 B2
(45) **Date of Patent: *Oct. 19, 2021**

(54) TAPPET ASSEMBLY WITH FORMED ANTI-ROTATION ALIGNMENT DEVICE

(71) Applicant: Koyo Bearings North America LLC, Greenville, SC (US)

(72) Inventors: Scott Abrahamson, Piedmont, SC (US); Josh Ferguson, Greer, SC (US)

(73) Assignee: Koyo Bearings North America LLC, Greenville, SC (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/062,888

(22) Filed: Oct. 5, 2020

(65) Prior Publication Data

US 2021/0102477 A1 Apr. 8, 2021

Related U.S. Application Data

(60) Provisional application No. 62/910,208, filed on Oct. 3, 2019.

(51) Int. Cl.
*F01L 1/14* (2006.01)

(52) U.S. Cl.
CPC ..... *F01L 1/14* (2013.01); *F01L 2305/02* (2020.05); *F01L 2307/00* (2020.05)

(58) Field of Classification Search
CPC ..... F01L 1/14; F01L 1/143; F01L 2305/02; F01L 2307/00
USPC ..... 123/90.48, 90.5
See application file for complete search history.

(56) References Cited

U.S. PATENT DOCUMENTS

| | | | |
|---|---|---|---|
| 1,613,117 | A | 1/1927 | Miller |
| 1,848,083 | A | 3/1932 | Wetherald |
| 2,891,525 | A | 6/1959 | Moore |
| 4,317,433 | A | 3/1982 | Fuhrmann |
| 4,335,685 | A | 6/1982 | Clouse |
| 4,829,950 | A | 5/1989 | Kanamaru et al. |
| 5,239,953 | A | 8/1993 | Shida |
| 5,280,771 | A | 1/1994 | Groh et al. |

(Continued)

FOREIGN PATENT DOCUMENTS

| | | | |
|---|---|---|---|
| DE | 3149356 | A1 | 6/1983 |
| DE | 3820645 | A1 | 12/1989 |

(Continued)

*Primary Examiner* — Jorge L Leon, Jr.
(74) *Attorney, Agent, or Firm* — Nelson Mullins Riley & Scarborough LLP

(57) ABSTRACT

A tappet assembly including an outer cup having a substantially cylindrical side wall, an annular lip portion disposed at a first end of the side wall, and an annular ledge disposed on the side wall, the annular ledge being disposed in a plane that is transverse to a longitudinal center axis of the tappet assembly. An inner cup includes an annular lip extending outwardly therefrom and a pair of shaft apertures, and is disposed in the outer cup so that the lip abuts the annular ledge of the outer cup and is non-rotatably fixed thereto by the annular lip of the outer cup which abuts the lip of the inner cup. A shaft is received in the shaft apertures, and a roller tappet is rotatably received on the shaft such that a portion of the roller tappet extends axially outwardly beyond the annular lip portion of the outer cup, and an alignment device formed in the outer cup.

5 Claims, 6 Drawing Sheets

(56) References Cited

U.S. PATENT DOCUMENTS

| | | | | |
|---|---|---|---|---|
| 5,553,512 | A | 9/1996 | Harimoto | |
| 5,664,530 | A | 9/1997 | Ammon et al. | |
| 5,904,123 | A | 5/1999 | Ammon et al. | |
| 5,954,020 | A | 9/1999 | Schmidt et al. | |
| 5,975,038 | A | 11/1999 | Fischer et al. | |
| 5,979,385 | A | 11/1999 | Speil et al. | |
| 6,192,846 | B1 | 2/2001 | Speil | |
| 6,619,251 | B2 | 9/2003 | Kobayashi et al. | |
| 6,684,838 | B2 | 2/2004 | Pluta et al. | |
| 7,143,731 | B2 | 12/2006 | Kirbach et al. | |
| 7,159,552 | B2 | 1/2007 | Backert et al. | |
| 7,793,583 | B2 | 9/2010 | Radinger et al. | |
| 8,201,532 | B2 | 6/2012 | Prokop | |
| 8,235,018 | B2 | 8/2012 | Dorn et al. | |
| 8,474,427 | B2 | 7/2013 | Dorn et al. | |
| 8,863,716 | B2 | 10/2014 | Dorn | |
| 9,032,863 | B2 | 5/2015 | Chambonneau et al. | |
| 9,243,521 | B2 | 1/2016 | Cornett et al. | |
| 10,119,607 | B2 | 11/2018 | Abrahamson | |
| 10,385,957 | B2 | 8/2019 | Abrahamson | |
| 2007/0215088 | A1 | 9/2007 | Haefner | |
| 2008/0190237 | A1* | 8/2008 | Radinger | F01L 1/143 74/569 |
| 2012/0125277 | A1 | 5/2012 | Chambonneau et al. | |
| 2013/0340695 | A1 | 12/2013 | Fujii et al. | |
| 2015/0090209 | A1* | 4/2015 | Berruet | F02M 37/06 123/90.26 |
| 2015/0090211 | A1 | 4/2015 | Champalou | |
| 2015/0192098 | A1 | 7/2015 | Dorn et al. | |
| 2015/0337941 | A1 | 11/2015 | Champalou et al. | |
| 2015/0361937 | A1 | 12/2015 | Geyer et al. | |
| 2016/0160986 | A1* | 6/2016 | Berruet | F16H 53/06 74/569 |
| 2017/0145877 | A1* | 5/2017 | Hauvespre | F01M 9/105 |
| 2017/0299037 | A1 | 10/2017 | Abrahamson | |
| 2017/0342951 | A1* | 11/2017 | Xu | F02M 59/102 |
| 2019/0063580 | A1 | 2/2019 | Abrahamson | |
| 2019/0085731 | A1* | 3/2019 | Xu | F01L 1/14 |

FOREIGN PATENT DOCUMENTS

| | | | |
|---|---|---|---|
| DE | 10360467 | A1 | 7/2005 |
| DE | 102013216562 | A1 | 2/2015 |
| EP | 2853697 | A1 | 4/2015 |
| EP | 2853699 | A1 | 4/2015 |
| GB | 1349040 | A | 3/1974 |
| GB | 1354338 | A | 6/1974 |
| JP | S5540269 | A | 3/1980 |
| JP | H03-294653 | A | 12/1991 |
| JP | 2004257286 | A | 9/2004 |
| JP | 2010-511834 | A | 4/2010 |
| JP | 2011094596 | A | 5/2011 |
| JP | 2013-217304 | A | 10/2013 |
| JP | 2015068503 | A | 4/2015 |
| KR | 10-2012-0067313 | A | 6/2012 |
| WO | 2006018069 | A1 | 2/2006 |
| WO | 2012013376 | A1 | 2/2012 |
| WO | 2015106051 | A1 | 7/2015 |

* cited by examiner

TAPPET ASSEMBLY WITH FORMED ANTI-ROTATION ALIGNMENT DEVICE

CLAIM OF PRIORITY

This application claims priority to U.S. provisional patent application No. 62/910,208 filed Oct. 3, 2019, the disclosure of which is incorporated by reference herein.

FIELD OF THE INVENTION

The present invention relates generally to tappet assemblies. More particularly, the present invention relates to designs and assembly methods of tappet assemblies and their associated alignment devices.

BACKGROUND OF THE INVENTION

Tappet assemblies are often used in a valve train of an internal combustion engine to transmit motion from a camshaft of the engine to one or more intake or exhaust valves. As the camshaft rotates, the tappet assemblies receive both a sideways force and a downward force from corresponding lobes on the camshaft, but only transmit the downward force to the valves to open and/or close the valves. Tappet assemblies thereby reduce the possibility of bending or otherwise damaging the valve stems of the valves. As well, tappet assemblies are often used in camshaft driven, high-pressure fuel pumps which are used in gasoline direct injection systems.

Existing bucket-type tappet assemblies typically include either a stamped or cold formed bucket. A roller tappet is typically supported on a shaft that is directly fixed to the bucket such as by staking, swaging, etc. As such, the bucket is a load bearing member and, therefore, requires heat treatment and operations such as grinding. As well, tappet assemblies often have some form of alignment device carried in an aperture defined by the bucket such that rotation of the tappet assemblies within its corresponding bore is prevented. One example of known alignment devices includes a mushroom-shaped pin that is fixed in an aperture of the tappet assembly's bucket. Such pins can be difficult to manufacture because of their complicated shapes. As well, required heat treatments of the bucket can cause distortion of the aperture which receives the alignment device, thereby complicating assembly. Such alignment devices are often fixed in their corresponding apertures by an interference fit.

The present invention recognizes and addresses considerations of prior art constructions and methods.

SUMMARY OF THE INVENTION

One embodiment of the present disclosure provides a tappet assembly that is movable within a bore along a longitudinal center axis of the bore, the assembly including an outer cup having an inner surface and an unground outer surface defining a substantially cylindrical side wall, an annular lip portion disposed at a first end of the side wall, and an annular ledge disposed on the inner surface of the side wall, the annular ledge being disposed in a plane that is transverse to a longitudinal center axis of the tappet assembly, an inner cup including an annular lip extending outwardly therefrom and a pair of shaft apertures, the inner cup being disposed in the outer cup so that the lip of the inner cup abuts the annular ledge of the outer cup and is non-rotatably fixed thereto by the annular lip of the outer cup which abuts the lip of the inner cup, a shaft having a first end and a second end, each of the first end and the second end being disposed in a corresponding one of the shaft apertures, and a roller tappet rotatably received on the shaft such that a portion of the roller tappet extends axially outwardly beyond the annular lip portion of the outer cup, and an alignment device formed in the outer cup.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1A:
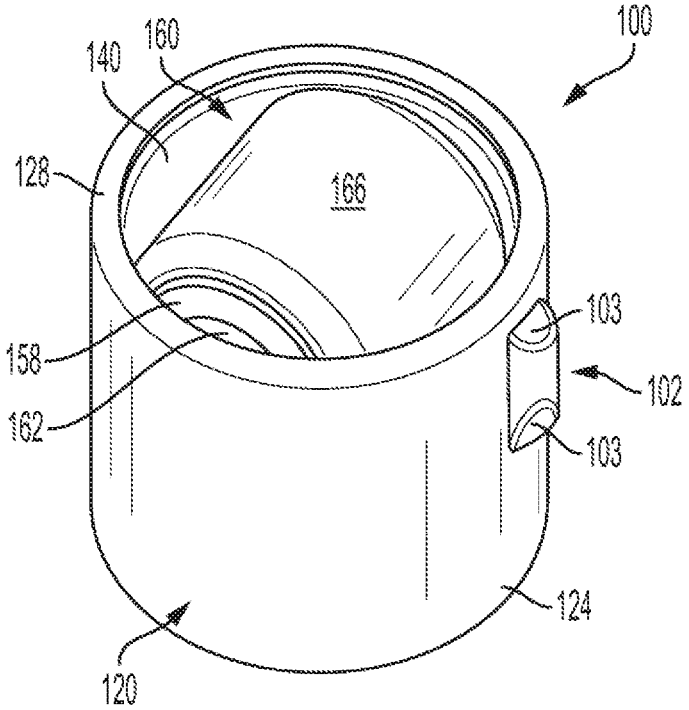
FIGS. 1A and 1B are perspective views of an embodiment of a tappet assembly, including an alignment device in accordance with the present disclosure.
Figure 1B:
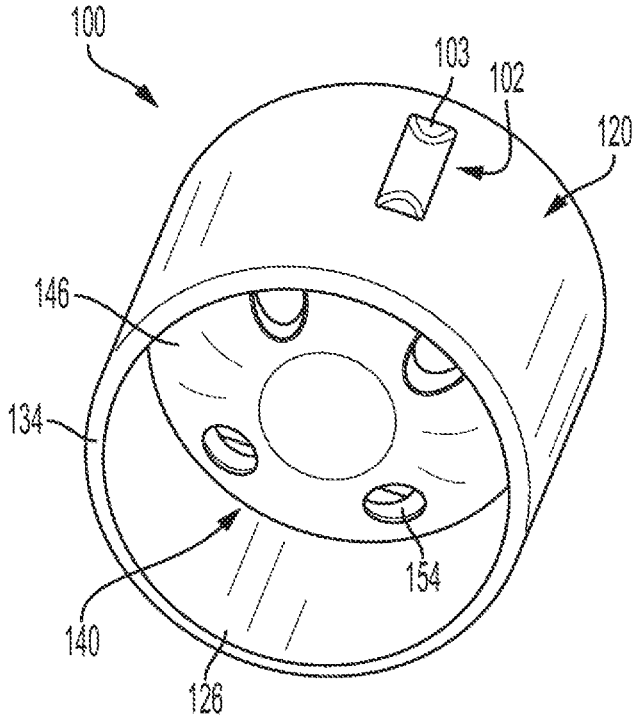

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, terms referring to a direction or a position relative to the orientation of the tappet assembly, such as but not limited to "vertical," "horizontal," "upper," "lower," "above," or "below," refer to directions and relative positions with respect to the assembly's orientation in its normal intended operation, as indicated in the Figures herein. Thus, for instance, the terms "vertical" and "upper" refer to the vertical direction and relative upper position in the perspectives of the Figures and should be understood in that context, even with respect to a tappet assembly that may be disposed in a different orientation.

Further, the term "or" as used in this disclosure and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provided illustrative examples for the terms. The meaning of "a," "an," and "the" may include plural references, and the meaning of "in" may include "in" and "on." The phrase "in one embodiment," as used herein does not necessarily refer to the same embodiment, although it may.

Figure 7:
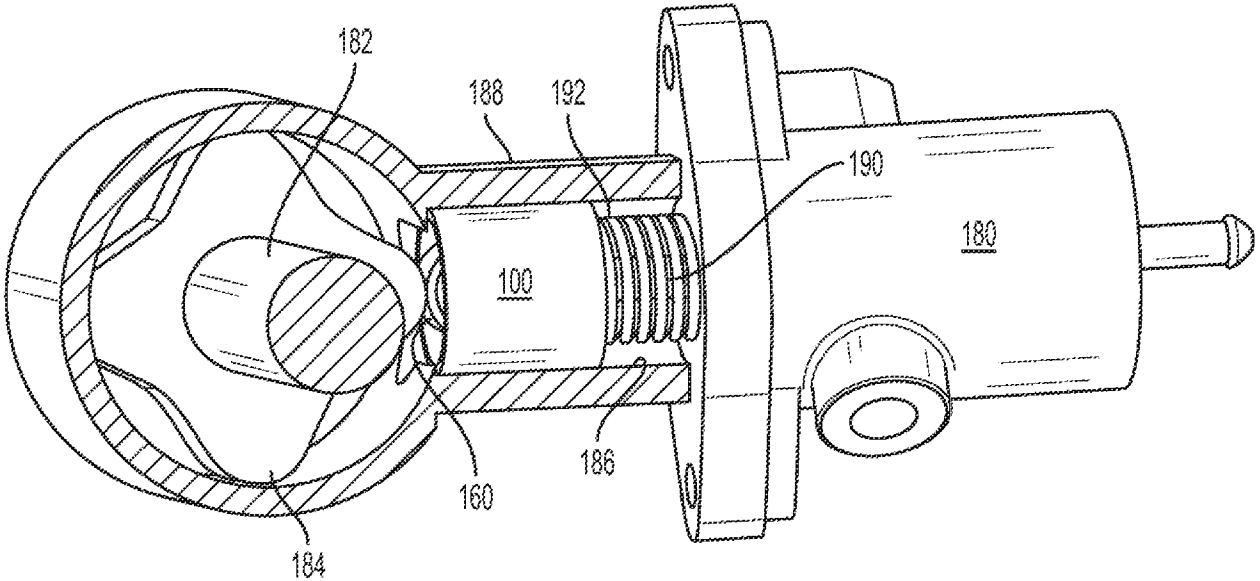
FIG. 7 is a partial cross-sectional view of a high pressure fuel pump including the tappet assembly shown in FIGS. 1A and 1B.

As shown in FIGS. 1A through 3C, an example embodiment of a tappet assembly 100 in accordance with the present disclosure includes a substantially cylindrical outer cup 120, an inner cup 140 received therein, a roller follower 160 supported by inner cup 140, and an alignment device 102 formed in outer cup 120. As shown in FIG. 7, tappet assembly 100 is used in a high-pressure fuel pump 180 of an internal combustion engine, although other uses for tappet assembly 100 are possible. As a camshaft 182 of the engine rotates, a lobe 184 of camshaft 182, or a rocker arm (not shown) connected to camshaft 182, engages roller follower 160 of tappet assembly 100 to convert the rotational motion of camshaft 182 into linear motion of tappet assembly 100 within a bore 186 of a corresponding cylinder head 188. A pump stem 190 of pump 180 is positioned within and connected to tappet assembly 100 such that, as tappet assembly 100 moves in a linear direction within bore 186, pump stem 190 is alternatingly moved left (as shown) by spring 192 and right by tappet assembly 100. Forces from camshaft 182 are thereby transmitted through tappet assembly 100 to pump 180 such that only forces in substantially the same direction as the motion of pump stem 190 act on pump 180. In addition, tappet assembly 100 serves as a torsional vibration isolation device between camshaft 182 and pump 180 to inhibit rotational forces from being transmitted. An alignment device 102, or anti-rotation feature, is formed by an outwardly-extending projection formed in the side wall of outer cup 120, a portion of which is slidably received in a correspondingly shaped alignment groove (not shown) defined by the inner wall of bore 186. As shown, the projection forming alignment device 102 is elongated in a direction parallel to a longitudinal center axis of tappet assembly 100 and includes a semi-cylindrical outer surface and slanted end walls 103.

Figure 5:
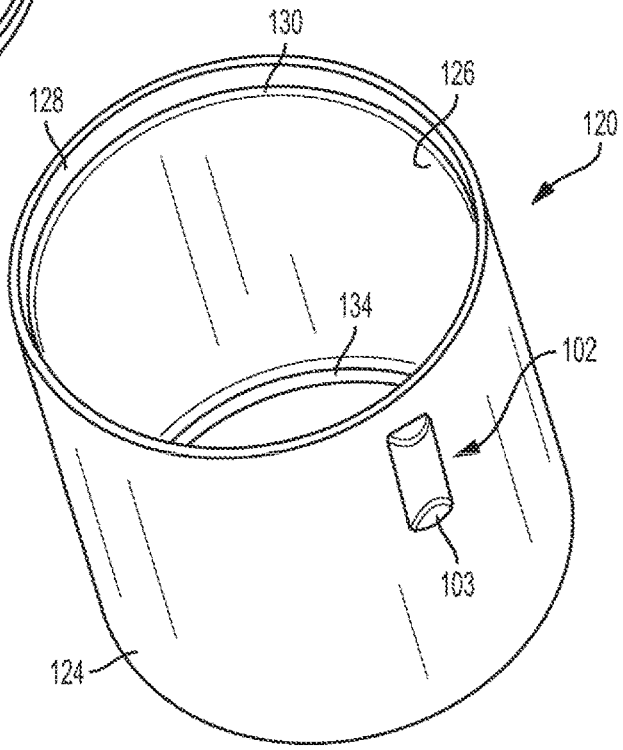
FIG. 5 is a perspective view of an outer cup of the tappet assembly shown in FIGS. 1A and 1B.

Referring additionally to FIG. 5, outer cup 120 of the present embodiment includes a cylindrical outer surface 124 and a cylindrical inner surface 126 substantially concentric therewith. Outer cup 120 is preferably formed from a sheet metal blank of low, medium, or high carbon plain or alloy steel by a precision drawing process that results in very good control of the surface finish, the outer diameter size, and roundness of the outer cup. Additionally, outer cup 120 includes an annular lip 128 and 134 formed at each of its opposing ends. Annular lip 128 is thinner in the radial direction than the remaining side wall of outer cup 120, forming an annular ledge 130 therewith. In its initial state, prior to fully assembling tappet assembly 100, annular lip 128 extends axially outwardly parallel to a longitudinal center axis 132 of outer cup 120, whereas annular ledge 130 lies in a plane that is transverse to longitudinal center axis 132. When forming outer cup 120, annular lip 134 may be initially formed extending radially inwardly as the other components of the roller follower are preferably placed into outer cup 120 from the end at which annular lip 128 is disposed.

Figure 3A:
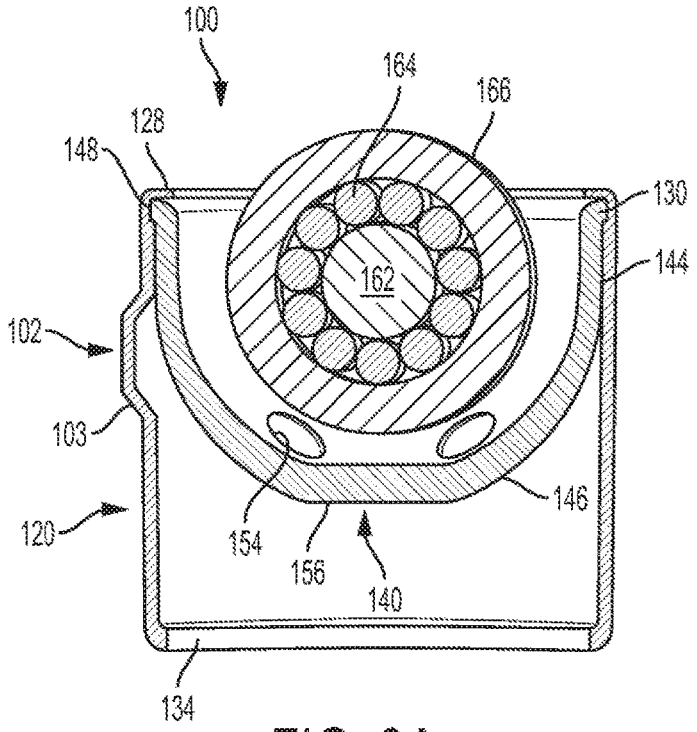
FIGS. 3A, 3B, and 3C are cross-sectional views of the tappet assembly shown in FIGS. 1A and 1B.
Figure 3B:
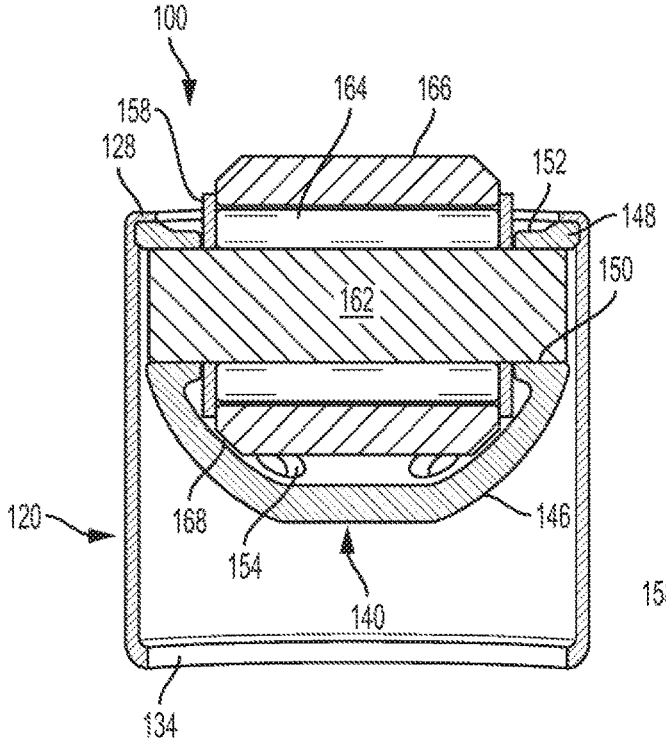
Figure 3C:
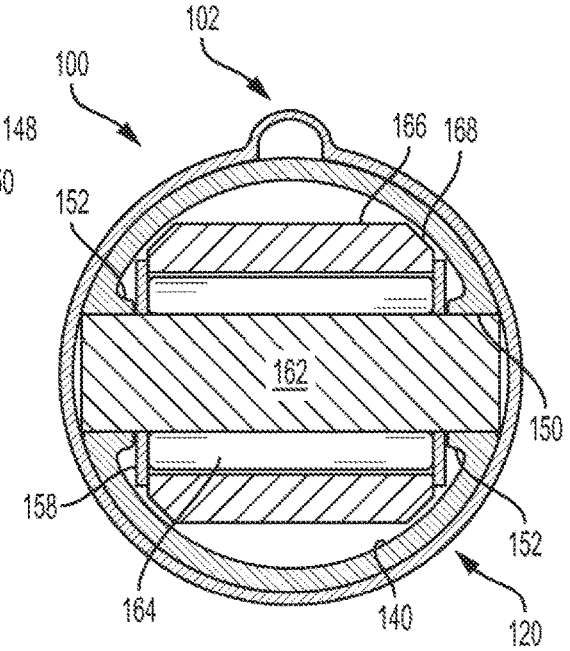
Figure 4A:
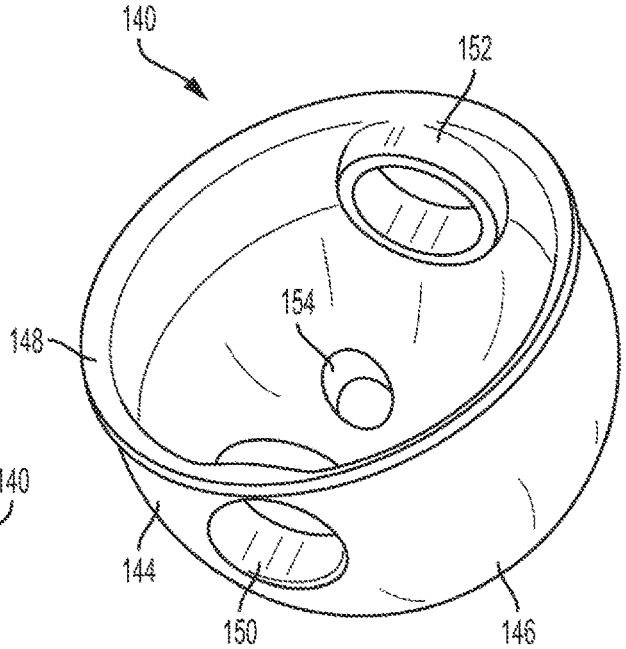
FIGS. 4A and 4B are perspective views of an inner cup of the tappet assembly shown in FIGS. 1A and 1B.
Figure 4B:
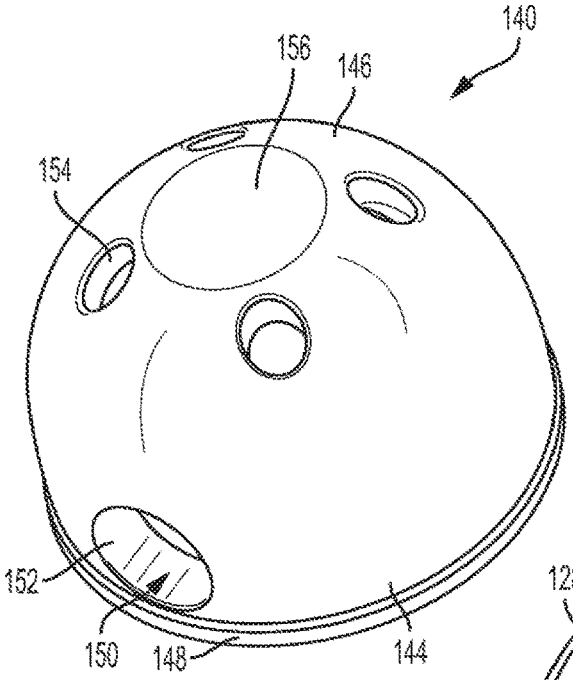

Referring additionally to FIGS. 4A and 4B, inner cup 140 preferably includes a cylindrical side wall 144, a semi-spherical bottom portion 146, an upper lip 148 extending radially outwardly from an upper perimeter of the side wall, and a pair of shaft apertures 150 defined by side walls 144. As best seen in FIGS. 1A, 3A, and 3B, when fully inserted in outer cup 120, upper lip 148 of inner cup 140 rests on annular ledge 130 of outer cup 120. Once fully inserted in outer cup 120, inner cup 140 is retained therein by folding annular lip 128 over inwardly, such as by crimping, spin curling, punch forming, etc., so that upper lip 148 is non-rotatably squeezed between annular lip 128 and annular ledge 130. Note, since outer cup 120 does not directly support shaft 162 of roller follower 160, it does not require the heat treatment and grinding processes that are typically performed on the outer cups of known tappet assemblies. As such, the folding/crimping operation performed on annular lip 128 is facilitated. However, in those applications where heat treatment of outer cup 120 is desired for wear purposes, the heat treatment process occurs after the formation of alignment device 102. Next, prior to folding, crimping, etc., annular lip 128 over inwardly, annular lip 128 is tempered to facilitate the operation and help prevent cracking.

Preferably, inner cup 140 is formed from a sheet metal blank by a stamping process, or drawing process, and is subjected to heat treatment processes as it directly supports shaft 162 of tappet assembly 100 and supports the cyclical force exerted by pump stem 190 (FIG. 7) on the bottom of inner cup 140. Prior to the heat treatment processes, shaft apertures 150 are pierced in side wall 144 of inner cup 140 and extruded so that a boss 152 is formed about each shaft aperture 150. Similarly, lubrication apertures 154 are also pierced in semi-spherical bottom portion 146 of inner cup 140 prior to any heat treatment processes. As shown, preferably, a portion of semi-spherical bottom portion 146 may be flattened, thereby forming a bottom wall 156 that is perpendicular to longitudinal center axis 132 of tappet assembly 100. Bottom wall 156 facilitates the transfer of forces from tappet assembly 100 to the corresponding pump stem 190, or in the alternative, valve stem. Note, however, in alternate embodiments, the cross-sectional shape of bottom portion 146 may have a constant radius of curvature. Alternatively, bottom portion 146 may be simply dome-shaped.

Figure 2:
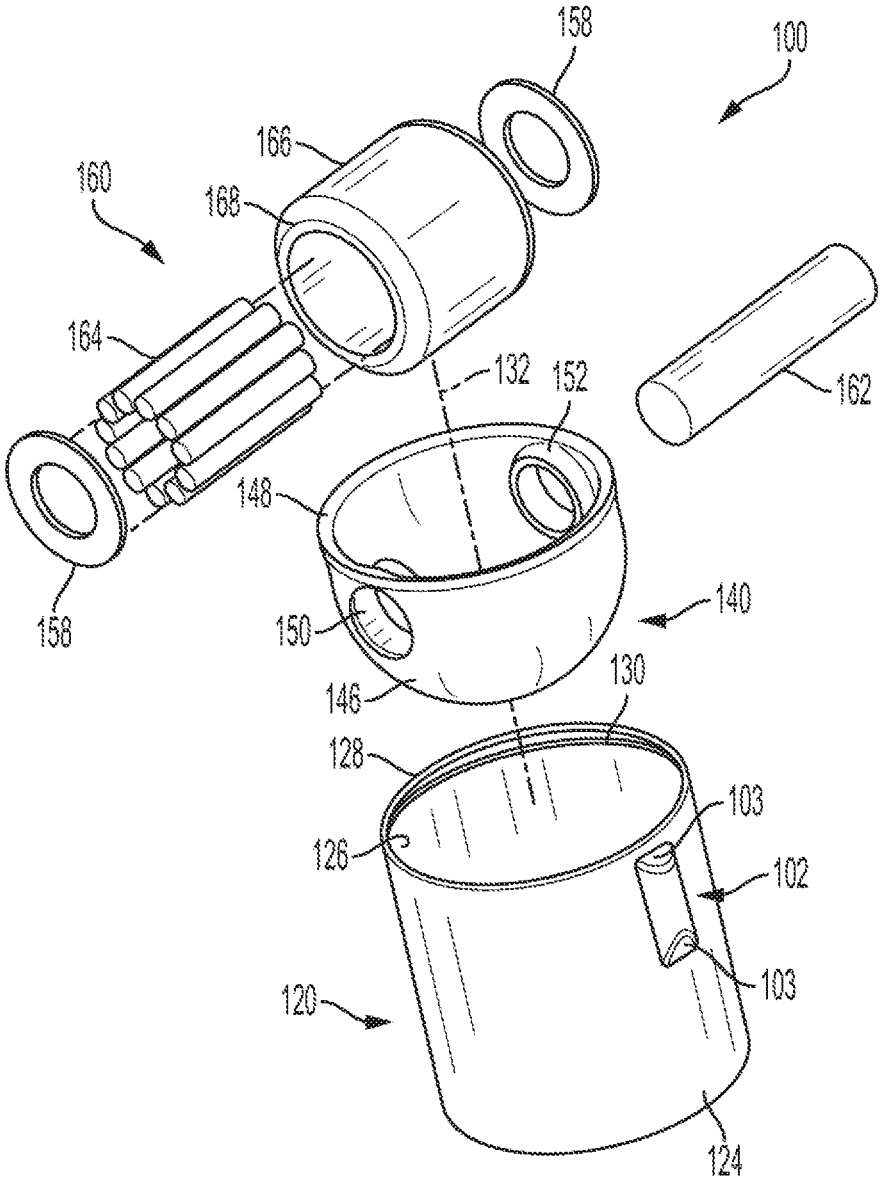
FIG. 2 is an exploded perspective view of the tappet assembly shown in FIGS. 1A and 1B.

As best seen in FIG. 2, roller follower 160 includes shaft 162, an outer race 166, and a plurality of rollers 164 disposed therebetween such that race 166 is freely rotatable about shaft 162. Opposite ends of shaft 162 are received in shaft apertures 150 of inner cup 140 such that roller follower 160 is mounted to outer cup 120 of tappet assembly 100 by way of the inner cup. When assembled, roller follower 160 extends axially outwardly beyond the top edge of outer cup 120 such that outer surface of race 166 engages a corresponding lobe 184 of camshaft 182, as shown in FIG. 7. Preferably, the diameters of shaft apertures 150 are slightly larger than the diameter of shaft 162 such that shaft 162 is free to rotate within shaft apertures 150 during operation. Alternately, the opposing ends of shaft 162 can be staked, swaged, etc., to inner cup 140 such that rotation relative thereto is prevented. Note, when shaft 162 is free to rotate within shaft apertures 150, the axial motion of shaft 162 is limited by abutment at either end with inner surface 126 of outer cup 120. Preferably, a washer 158 is disposed at each end of race 166 to limit the motion of both race 166 and rollers 164 along shaft 162. Preferably, annular beveled edges 168 are provided on the opposite ends of outer race 166 to allow the overall size of outer race 166 to be maximized, yet not make contact with the inner surface of semi-spherical bottom portion 146 of inner cup 140.

Known gasoline direct injection (GDI) tappet assembly designs require grinding the outside diameter of their respective outer cups to insure that the diameter and roundness tolerances will be tight enough to control the tappets in the housing bore under the extreme conditions often experienced in GDI applications. In contrast, the presently disclosed tappet assemblies have unique capabilities that allow them to function in the GDI's extreme conditions, as well or better than existing GDI tappet designs. These capabilities are possible due to the fact that the outer cup 120 is decoupled from the load path and how the tappet assembly 100 does not utilize an outer cup with a ground outer surface. As noted, a ground outer surface is not required due to forming the outer cup 120 by way of a precision drawing process. In the disclosed embodiments, the outer cup 120 is almost an entirely unbroken cylinder, less the alignment device 102. This maximizes the stability of the tappet assembly 100 while also maximizing the oil film that builds between the tappet assembly 100 and the housing bore. The enhanced oil film and stability improves the lubrication thus reducing the potential for metal-to-metal contact between tappet assembly 100 and the housing bore. Prior art tappet assemblies tend to have relieved portions of the outer cup that reduce the overall area for allowing the build-up of an oil film, and therefore reduce the lubrication between the housing and the tappet assembly 100. Further, since the outer cup 120 of the disclosed embodiments is unground, the tappet assemblies of the present disclosure may utilize an alignment device 102 that is formed into the side wall of the outer cup, as previously discussed. The alignment device 102 is required in all GDI tappet designs to control the angular position of the tappet assembly 100 during operation. Moreover, because the load path does not go through the outer cup 120 of the tappet assembly 100, the outer cup 120 can be designed with a lower stiffness than in known tappet assemblies, allowing for increased outer cup conformity to the housing bore.

As well, not grinding the outer surface of the outer cup 120 offers efficiencies in manufacturing. In known prior art tappet designs that use a ground outer cup, the grinding operation or the outer surface makes it impractical to form the alignment device 102 into the outer cup because the grinding operation necessarily occurs after the forming of the alignment device 102. Therefore, the formed alignment device 102 would interfere with the grinding process and require very expensive process techniques to attempt to support grinding the outer cup with a previously formed alignment device 102, or the alignment device 102 would have to be formed after the outer cup is already in the hard state. Moreover, because the load path does not go through the outer cup 120 of the tappet assembly 100, the outer cup 120 can be designed with a lower stiffness than in known tappet assemblies, allowing for increased outer cup conformity to the housing bore.

Figure 6A:
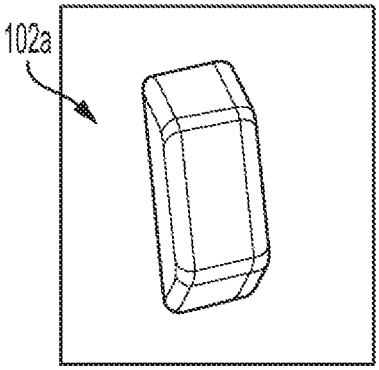
FIGS. 6A through 6E are perspective views of alignment devices in accordance with alternate embodiments of the present disclosure.
Figure 6B:
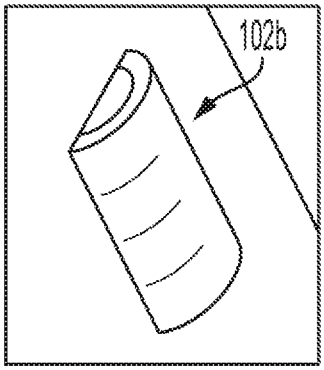
Figure 6C:
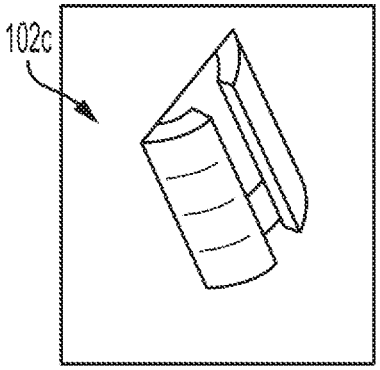
Figure 6D:
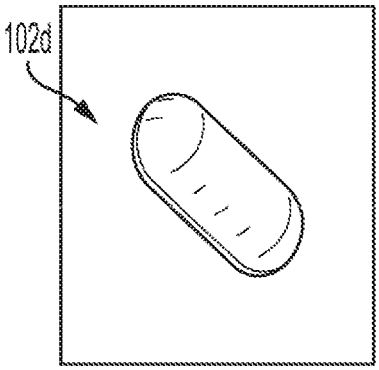
Figure 6E:
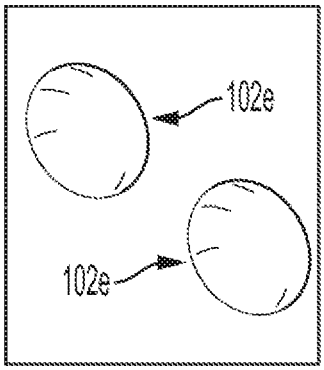

In addition to the shape of the alignment device 102 shown in FIG. 1, FIGS. 6A through 6E illustrate that there are many possible shapes for the formed alignment device. As shown, the present embodiments allow for devices 102*a* having side walls forming right angles, devices 102*b* and 102*c* formed by piercing operations, and devices 102*d* and 102*e* having semi-spherically shaped portions, which offer increased stiffness. As shown in FIG. 6E, device 102*e* is formed by multiple individual features. The present disclosure provides the flexibility to form a specific shape of alignment device 102 to meet differing specifications. As well, forming an alignment device 102 into an unground outer cup allows the length of the alignment device 102 to be varied to better support the requirements of the desired application.

While one or more preferred embodiments of the invention are described above, it should be appreciated by those skilled in the art that various modifications and variations can be made in the present invention without departing from the scope and spirit thereof. It is intended that the present invention cover such modifications and variations as come within the scope and spirit of the appended claims and their equivalents.

The invention claimed is:

1. A tappet assembly movable within a bore along a longitudinal center axis of the bore, the tappet assembly comprising:

an outer cup having an inner surface and an unground outer surface defining a substantially cylindrical body, an annular lip portion disposed at a first end of the outer cup, and an annular ledge disposed on the inner surface, the annular ledge extending perpendicular to the longitudinal center axis of the bore;

an inner cup including an outwardly extending annular lip and first and second shaft apertures, the inner cup being disposed in the outer cup such that the annular lip of the inner cup abuts the annular ledge;

a shaft having a first end and a second end disposed in the first and second shaft apertures, respectively;

a roller follower rotatably received on the shaft such that a portion of the roller follower extends axially outwardly beyond the annular lip portion of the outer cup; and an alignment device formed in the outer cup, wherein the annular lip portion of the outer cup is deformed such that the annular lip of the inner cup is squeezed between the annular ledge and the annular lip portion of the outer cup so as to fix the inner cup to the outer cup.

2. The tappet assembly of claim 1, wherein the inner cup further comprises a side wall including two opposed curved portions, a pair of parallel side portions extending between the two curved portions, and a semi-spherical bottom portion disposed at a bottom end of the side wall, wherein the annular lip of the inner cup extends radially outwardly from a top end of the side wall.

3. The tappet assembly of claim 2, wherein the inner cup further comprises at least one lubrication aperture defined by the semi-spherical bottom portion.

4. The tappet assembly of claim 2, wherein the semi-spherical bottom portion of the inner cup further comprises a flat bottom wall that is perpendicular to a longitudinal center axis of the tappet assembly.

5. The tappet assembly of claim 1, wherein the roller follower further comprises an outer race and a plurality of rollers, wherein the plurality of rollers is disposed between the outer race and the shaft.

* * * * *